US012729612B2

(12) United States Patent
Al Sulaiman et al.

(10) Patent No.: US 12,729,612 B2
(45) Date of Patent: Sep. 8, 2026

(54) APPARATUS AND METHOD FOR MILLING OPENINGS IN AN UNCEMENTED BLANK PIPE

(71) Applicant: Saudi Arabian Oil Company, Dhahran (SA)

(72) Inventors: Ahmed A. Al Sulaiman, Dammam (SA); Feras Hamid Rowaihy, Dhahran (SA); Mamdouh N. Al-Nasser, Dhahran (SA); Suresh Jacob, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/273,311

(22) Filed: Jul. 18, 2025

(65) Prior Publication Data

US 2025/0347204 A1 Nov. 13, 2025

Related U.S. Application Data

(62) Division of application No. 18/515,465, filed on Nov. 21, 2023, now Pat. No. 12,410,691, which is a division of application No. 17/208,525, filed on Mar. 22, 2021, now Pat. No. 11,859,472.

(51) Int. Cl.

| | |
|---|---|
| ***E21B 43/12*** | (2006.01) |
| ***E21B 23/01*** | (2006.01) |
| ***E21B 29/06*** | (2006.01) |
| ***E21B 33/12*** | (2006.01) |
| ***E21B 43/14*** | (2006.01) |
| ***E21B 49/08*** | (2006.01) |

(52) U.S. Cl.

CPC ..... *E21B 43/12* (2013.01); *E21B 23/01* (2013.01); *E21B 29/06* (2013.01); *E21B 33/12* (2013.01); *E21B 43/14* (2013.01); *E21B 49/0875* (2020.05)

(58) Field of Classification Search

CPC ..... E21B 43/12; E21B 23/01; E21B 29/06; E21B 33/12; E21B 43/14; E21B 49/0875; E21B 33/13

See application file for complete search history.

(56) References Cited

U.S. PATENT DOCUMENTS

| | | | | |
|---|---|---|---|---|
| 2,327,023 A * | 8/1943 | Danner | ..... | E21B 49/06 91/410 |
| 2,500,785 A * | 3/1950 | Arutunoff | ..... | E21B 7/061 175/203 |
| 2,539,047 A * | 1/1951 | Arutunoff | ..... | E21B 7/061 175/308 |

(Continued)

*Primary Examiner* — Steven A Macdonald

(74) *Attorney, Agent, or Firm* — Dinsmore & Shohl LLP

(57) ABSTRACT

This disclosure relates to an inflow control system having an apparatus configured to form or plug openings in a blank pipe. The apparatus includes a housing and a milling sub-system. The housing has a cylindrical wall with an outer surface. The milling sub-system is mounted to a first side of the wall and is configured to mill an opening in the blank pipe. The milling sub-system includes a bit configured to form an opening in the blank pipe and at least one brace attached to a second side of the wall opposite the first side of the wall. The at least one brace is configured to extend radially from the second side of the wall to press the bit to the inner surface of the blank pipe.

4 Claims, 10 Drawing Sheets

(56) References Cited

U.S. PATENT DOCUMENTS 2,696,112 A * 12/1954 Griffith ..... E21B 47/11 73/152.18
3,167,122 A * 1/1965 Lang ..... E21B 29/10 29/421.2
3,225,828 A * 12/1965 Wisenbaker ..... E21B 29/00 166/55
3,598,191 A * 8/1971 Bullard ..... E21B 49/06 175/77
3,630,296 A * 12/1971 Bullard ..... E21B 49/06 175/58
4,028,546 A * 6/1977 Peelman ..... G01F 1/64 376/118
5,553,680 A * 9/1996 Hathaway ..... E21B 7/04 175/162
5,636,686 A * 6/1997 Wittrisch ..... E21B 47/01 166/50
5,738,178 A * 4/1998 Williams ..... E21B 4/02 175/73
6,125,949 A * 10/2000 Landers ..... F16C 1/04 175/62
6,189,629 B1 * 2/2001 McLeod ..... E21B 7/18 175/321
6,516,275 B2 * 2/2003 Lazaratos ..... G01V 1/362 702/5
6,549,879 B1 * 4/2003 Cullick ..... E21B 49/00 703/2
6,931,324 B2 * 8/2005 Taner ..... G01V 1/306 702/17
7,088,639 B2 * 8/2006 Walls ..... G01V 1/30 702/14
7,108,067 B2 * 9/2006 Themig ..... E21B 34/142 166/334.4
7,376,517 B2 * 5/2008 Rickett ..... G01V 1/28 702/17
7,555,389 B2 * 6/2009 Cavalca ..... G01V 1/28 702/14
8,631,877 B2 * 1/2014 Gewily ..... E21B 33/124 166/387
9,031,820 B2 * 5/2015 Frederick ..... B29C 64/112 703/10
9,217,328 B2 * 12/2015 Yang ..... E21B 44/04
9,506,325 B2 * 11/2016 Fould ..... E21B 43/14
9,695,676 B2 * 7/2017 Kriesels ..... E21B 43/105
10,563,483 B2 * 2/2020 Steele ..... E21B 47/12
10,590,741 B2 * 3/2020 Van Der Veen .... E21B 41/0035
10,683,719 B2 * 6/2020 Motland ..... E21B 43/11
11,332,997 B2 * 5/2022 Hitchcock ..... E21B 33/13
11,536,107 B2 * 12/2022 Wiesenborn ..... E21B 4/06
11,859,472 B2 * 1/2024 Al Sulaiman ..... E21B 33/12
12,385,356 B2 * 8/2025 Wiesenborn ..... E21B 41/0085
2001/0050172 A1 * 12/2001 Tolman ..... E21B 43/27 166/305.1
2002/0005286 A1 * 1/2002 Mazorow ..... E21B 49/06 166/255.3
2003/0131986 A1 * 7/2003 Schultz ..... H02K 7/1823 166/66.5
2005/0000692 A1 * 1/2005 Cook ..... E21B 33/12 166/309
2008/0149203 A1 * 6/2008 Atkinson ..... E21B 43/32 137/624.11
2008/0166132 A1 * 7/2008 Lynde ..... E21B 29/06 398/142
2008/0257544 A1 * 10/2008 Thigpen ..... E21B 47/10 166/250.01
2009/0326826 A1 * 12/2009 Hull ..... E21B 47/103 702/12
2010/0097886 A1 * 4/2010 Day ..... G01V 1/364 367/24
2011/0000669 A1 * 1/2011 Barlow ..... E21B 43/12 166/63
2011/0297371 A1 * 12/2011 Church ..... E21B 47/11 166/66
2012/0029702 A1 * 2/2012 Tverlid ..... E21B 29/005 700/275
2012/0261127 A1 * 10/2012 Zhou ..... E21B 21/103 166/118
2012/0273236 A1 * 11/2012 Gandikota ..... E21B 23/01 166/207
2012/0318579 A1 * 12/2012 Yang ..... E21B 44/005 175/44
2014/0020896 A1 * 1/2014 Al-Gouhi ..... E21B 43/263 166/55
2014/0076560 A1 * 3/2014 Kenyon ..... E21B 34/10 166/321
2014/0170025 A1 * 6/2014 Weiner ..... G01N 33/2823 422/82.01
2014/0311729 A1 * 10/2014 Pasvandi ..... E21B 43/112 166/55.3
2014/0360784 A1 * 12/2014 Hunziker ..... E21B 10/02 175/58
2015/0168573 A1 * 6/2015 Zhang ..... G01V 1/30 702/17
2015/0267475 A1 * 9/2015 Marlow ..... E21B 7/18 175/45
2016/0032696 A1 * 2/2016 Caccialupi ..... E21B 43/108 166/207
2016/0091623 A1 * 3/2016 Yu ..... G01V 1/48 702/6
2016/0130904 A1 * 5/2016 Andersen ..... B23C 3/00 166/298
2016/0178772 A1 * 6/2016 Carter ..... G01V 1/36 702/17
2017/0321547 A1 * 11/2017 Enkababian ..... G01N 15/088
2019/0063214 A1 * 2/2019 Castillo ..... E21B 17/1057
2019/0100973 A1 * 4/2019 Lauritzen ..... E21B 23/01
2019/0120048 A1 * 4/2019 Coffin ..... G01N 33/2823
2020/0240266 A1 * 7/2020 Hunter ..... E21B 43/14
2020/0332615 A1 * 10/2020 Wiesenborn ..... E21B 29/005
2022/0213775 A1 * 7/2022 Kayode ..... E21B 43/00
2022/0298897 A1 * 9/2022 Al Sulaiman ..... E21B 43/12
2023/0115832 A1 * 4/2023 Wiesenborn ..... E21B 29/005 166/298
2025/0361792 A1 * 11/2025 Wiesenborn ..... E21B 4/06

* cited by examiner

250

APPARATUS AND METHOD FOR MILLING OPENINGS IN AN UNCEMENTED BLANK PIPE

CROSS REFERENCE TO RELATED PATENT APPLICATIONS

This application is a divisional of and claims the benefit of priority to U.S. patent application Ser. No. 18/515,465, filed Nov. 21, 20223, which is a divisional of and claims the benefit of priority to U.S. patent application Ser. No. 17/208,525, filed Mar. 22, 2021, the contents of which are incorporated by reference herein.

TECHNICAL FIELD

This disclosure relates to apparatuses and methods for forming and closing openings in a blank pipe arranged in a wellbore.

BACKGROUND

Passive in flow control devices (ICDs) are used in a large number of horizontal wells to balance inflow along horizontal wellbore. A typical ICD completion in a horizontal well consists of an open-hole section drilled in the reservoir and a completion consisting of open hole packers, ICDs and blank pipe. The combinations of these equipment divide the wellbore into separate inflow compartments or segments. The length of each segment will depend on reservoir heterogeneity and properties along the drilled wellbore. Production from open-hole section in each segment enters the tubing through the ICDs in that segment after exerting additional pressure drop across the ICDs.

SUMMARY

In certain aspects, an inflow control system includes an apparatus configured to form or plug openings in a blank pipe. The apparatus has a housing and a milling sub-system. The housing includes a cylindrical wall having an outer surface. The milling sub-system is mounted to a first side of the wall and configured to mill an opening in the blank pipe the milling sub-system includes a bit and at least one brace. The bit is configured to form an opening in the blank pipe. The at least one brace is attached to a second side of the wall opposite the first side of the wall, the at least one brace configured to extend radially from the second side of the wall to press the bit to the inner surface of the blank pipe.

Some systems also include inflow control devices arranged in the blank pipe. The inflow control devices are configured to control a fluid connection between the formation and an interior volume of the blank pipe. An inner face of the blank pipe defines the interior volume.

Some systems also include a plug sub-system configured to cover an opening in the blank pipe. In some cases, the plug sub-system includes a plug and a plug carrier. In some embodiments, the plug sub-system includes a clad releasably attached to a clad carrier of the plug sub-system. The carrier is configured to press the clad to an inner surface of the blank pipe and apply an expanding force to the clad to engage the clad with the blank pipe.

Some systems also include a plurality of packers configured to be arranged circumferentially around a wellbore casing at a respective plurality of depths to separate the wellbore casing into a plurality of portions. In some cases, each of the plurality of portions of the blank pipe has an inflow control device.

In some embodiments, the apparatus further includes a computer system operatively coupled to the milling sub-system, the computer system having one or more processors and a computer-readable medium storing instructions executable by the one or more processors to perform operations. The operations include analyzing wellbore data to estimate water cuts of areas of the formation, wherein the wellbore data comprises data generated by a horizontal multi-phase production log, identifying a portion of the blank pipe that are arranged in high-oil producing areas of the formation that have an estimated water cut of 0% to about 30%, prompting an alignment sub-system to align the bit of the apparatus with the identified portion of the blank pipe, and actuating the milling sub-system to generate an opening in the blank pipe.

Some apparatuses also include a computer system operatively coupled to the plug sub-system, the computer system include one or more processors and a computer-readable medium storing instructions executable by the one or more processors to perform operations. The operations include analyzing, prior to an oil recovery operation, wellbore data to estimate oil and water cuts of areas of the formation, wherein the wellbore data comprises data generated by a horizontal multi-phase production log, identifying a portion of the blank pipe arranged in high-water producing areas of the formation that have an estimated water cut of at least 50% prompting an alignment sub-system to align a plug sub-system with the identified high-water producing area, and actuating the plug sub-system to cover an opening in the blank pipe.

Some apparatuses also include an anchor extending around the outer surface of the wall. The anchor is configured to releasably mount the apparatus to blank pipe. The anchor can extend helically around the outer surface of the wall.

Some system also include an alignment sub-system configured to orient the apparatus such that the milling sub-system is aligned with a portion of the blank pipe. The alignment sub-system can include at least one casing collar locator configured to sense the depth and orientation of the drill bit relative to the blank pipe.

Some systems also include a sensor arrangement configured to measure a pressure received by the drill bit.

In certain aspects, a method is disclosed to increase an inflow of oil into a blank pipe. The method includes analyzing, prior to the inflow of oil into the blank pipe, wellbore data to estimate water cuts of areas of the formation, identifying areas of the formation with an estimated water cut between 0% and 20%, detecting at least one portion of the blank pipe arranged in the identified areas of the formation with the estimated water cut between 0% and 20%, actuating an alignment sub-system of the apparatus to align with the at least one portion of the blank pipe, and actuating a milling sub-system of the apparatus to mill an opening in the blank pipe. The openings may be 20 mm to 40 mm in diameter.

The method can also include analyzing the wellbore data to estimate a water cut of areas of the formation, and detecting at least one portion of the blank pipe arranged in an area of the formation with an estimated water cut of at least 50%.

Some methods also include receiving, during the inflow of oil into the blank pipe, production data from a sensor arrangement of the apparatus, wherein the production data comprises measurements indicative of the measured water cut of the areas of the formation, identifying an area of the formation that has an measured water cut between 0% and 20%, and actuating the alignment sub-system to align the apparatus with portions of the blank pipe arranged in the identified area of the formation that have an measured water cut between 0% and 20%. In some embodiments, the method includes actuating the milling sub-system to mill an opening in the portion of the blank pipe arranged in the area of the formation that has a measured water cut between 0% to about 20%.

In certain aspects, a method to reduce an inflow of water into an uncemented blank pipe is disclosed. The method includes analyzing, prior to the inflow of water from the formation into the blank pipe, wellbore data to estimate water cut of areas of the formation, identifying areas of the formation with an estimated water cut of at least 50%, detecting at least one portion of the blank pipe arranged in the identified areas of the formation with the estimated water cut of at least 50%, actuating an alignment sub-system of the apparatus to align with the at least one portion of the blank pipe, and actuating a plug sub-system of the apparatus to cover an opening in the at least one section of the blank pipe.

In some methods, actuating the plug sub-system of the apparatus to cover the opening in the at least one section of the blank pipe includes actuating the plug sub-system of the apparatus to cover an inflow control device in the blank pipe.

In some embodiments, the openings are 20 mm to 300 mm in diameter.

Some methods also include analyzing the wellbore data to water cut of areas of the formation, and detecting a portion of the blank pipe arranged in an area of the formation with an estimated water cut between 0% and 20%.

Some methods also include receiving, during the inflow of water from the formation into the blank pipe, production data from a sensor arrangement of the apparatus, wherein the production data comprises measurements indicative of a measured water cut of the areas of the formation, identifying an area of the formation that has the measured water cut of at least 50%, and actuating the alignment sub-system to align the apparatus with portions of the blank pipe arranged in the identified area of the formation that have the measured water cut of at least 50%. In some cases, the method also includes actuating the plug sub-system to close an opening and/or inflow control device in the portion of the blank pipe arranged in the area of the formation that has a measured water cut between 0% and 30%

The details of one or more embodiments disclosed are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
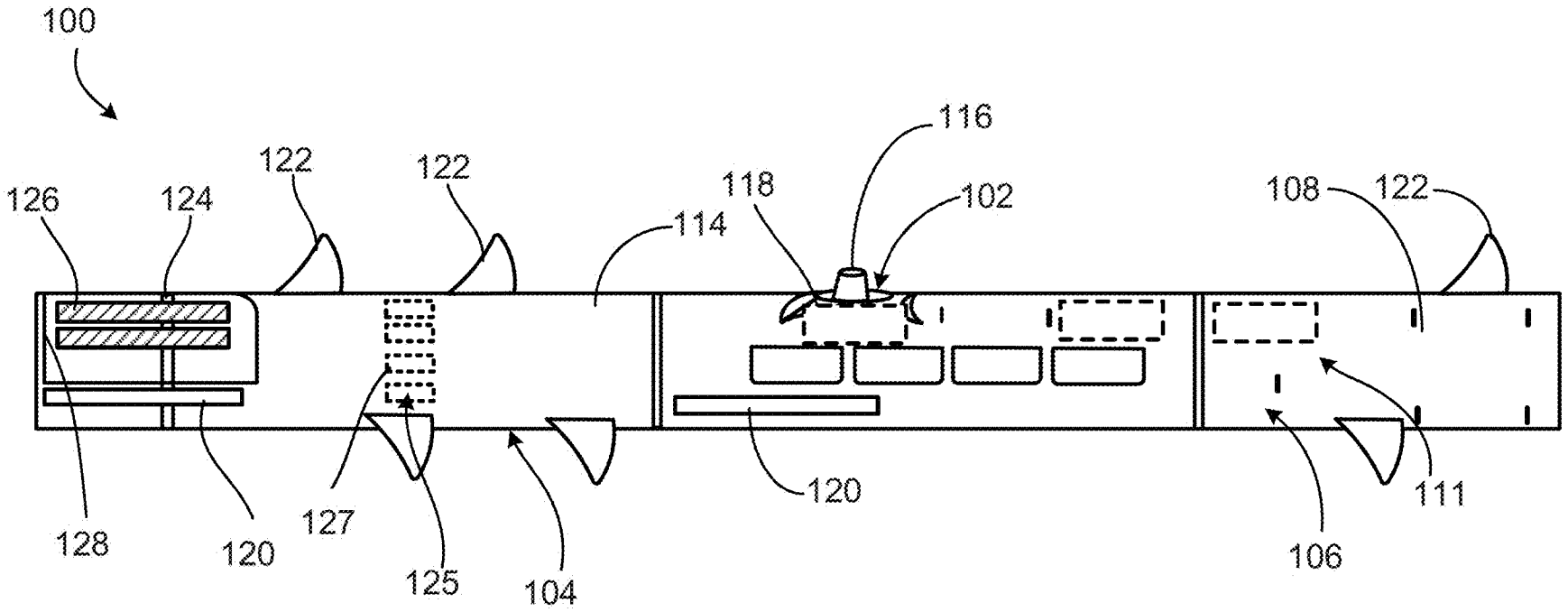
FIG. 1 is a view of an apparatus for generating openings with a milling sub-system of the apparatus.

An apparatus, system, and methods are disclosed for milling openings and closing openings in an uncemented blank pipe arranged in a horizontal well. The apparatus includes a milling sub-system for generating an opening in the blank pipe, and a plug sub-system for covering an opening generated by the milling system. The plug sub-system can also cover inflow control devices (ICDs) arranged in the blank pipe. The milling sub-system includes a bit (e.g., a drill bit) and braces that move the bit in contact with the blank pipe to generate the opening. The milling sub-system generates large, precise openings of a predetermined diameter, without compromising the integrity of the blank pipe. The milling sub-system forms openings in the blank pipe while reducing the risk of damage (e.g., cracking, splitting) to the blank pipe. In addition, the apparatus adjusts the number and size of the openings based on analysis and modeling of the formation, for example, the apparatus may mill openings near an area of the formation that is identified as a high-oil producing area and may close openings near areas of the formation that are identified as high-water producing areas.

This configuration and methods increase the life of the well, increase the oil content of the recovered fluid, increase the amount of oil recoverable from the formation, and reduce the amount of ground water removed from the ground. The system operates riglessly and is cost effective by reducing downtime of the well.

A high oil-producing area of the formation is identified by performing a multi-phase production log (PLT) and analyzing a produced water cut of the area of the formation. The produced water cut is the water produced rate divided by the total fluid produced rate and can be determined by a PLT or saturation log. Saturation logs can be taken at any time in the life of the well. A high oil-producing area is an area of the formation that has a produced water cut of 0% to 20% with an oil rate of about 1,000 barrels (bbl) per day (d). A 0% to 20% water cut is also known as "dry oil" or "low water" areas. In some cases, a high-oil producing area is identified by determining the oil production rate or by comparing the oil production rate of adjacent areas of the formation. A high water producing area is an area of the formation with a water cut of 50% or more. The estimated water cut in various areas of the formation is initially determined by analyzing wellbore data. Wellbore data can include horizontal multi-phase production logs, pressure data, and saturation data (generated by a saturation log), taken prior to oil recovery operations, for example prior to an inflow of oil or water from the formation, into the blank pipe. Wellbore data can also include fluid production data, for example, the water cut, formation permeability, reservoir pressure, relative permeability curves, productivity index, fluid PVT data, and formation skin damage as suggested by a pressure transient test. After estimating or calculating the water cuts of each area of the formation, the wellbore data is used to generate models that identify the portions of the blank pipe arranged in the high-oil producing areas, having a water cut of 0-20%, or high water-producing areas, having a water cut of 50% or greater. The models determine where to place additional openings to be milled by the apparatus. In some cases, the blank pipe may be arranged in a high oil-producing area but may not benefit from additional openings. For example, the openings may not be economically viable and/or may not increase the oil production enough to warrant intervention with the apparatus. The analysis of the model also determines the size of the openings. The size of the opening is determined by a processor to reduce any pressure drop across the blank pipe while maintaining the structural integrity of the blank pipe. Over the course of oil recovery, high-oil producing areas may transition into high-water producing areas as the oil in the high-oil producing areas is recovered and removed from the formation. During oil recovery the system can also analyze current wellbore data, measured during oil recovery, to detect, confirm, or re-categorize the high-oil producing areas and/or the high-water producing areas in real time. For example, the system may prompt or run additional saturation tests or PLT logs, analyze oil productions rates, water production rates, and/or the water cut.

FIG. 1 is a view of an apparatus 100 for generating openings with a milling sub-system 102. The apparatus 100 includes a housing 104 having a cylindrical wall 106. The cylindrical wall 106 has an outer surface 108 on which the milling sub-system 102 is mounted. The housing 104 holds a processor 110. The processor 110 is in communication with the milling sub-system 102 so that the processor 110 actuates the milling sub-system 102.

The milling sub-system 102 is mounted to an upper (first) side 114 of the wall 106 and is configured to mill an opening (not shown) in a blank pipe (not shown). The milling sub-system 102 includes a bit, for example a drill bit 116, and a motor, for example a drill bit motor 118. The drill bit 116 is configured to form the opening in the blank pipe by extending from the wall 106 and rotating, described in further detail with reference to FIGS. 3A-3D. The milling sub-system 102 also includes braces 120 attached to a (bottom) second side 121 of the wall 106. The braces 120 extend radially to move the drill bit 116, with the housing 104, towards the blank pipe. The braces 120 are arranged on the wall 106 at an opposite side from the drill bit 116. The braces 120 are hinged arms connected to a motor. The arms rotate about a hinge to move from a retracted position to an extended (or partially extended) position, moving the drill bit 116 towards an inner surface of the blank pipe. The braces 120 are about 1 foot (ft) to 3 ft in length. Some housings have recesses that receive the braces during transport and alignment. Some braces are expandable arms.

In use, the braces 120, drill bit motor 118, and the drill bit 116 generate an opening in an uncemented blank pipe by gradually applying pressure to the blank pipe via the drill bit 116. This configuration and gradual application of force prevents the blank pipe from cracking and results in precise openings of a known size and location.

The milling sub-system 102 also includes anchors 122 that extend around the outer surface 108 of the wall 106. The anchors 122 are arranged helically around the outer surface 108 of the wall 106. The anchors 122 releasably engage the inner surface of the blank pipe to temporarily mount the apparatus 100 to the blank pipe. The anchors 122, when engaged, prevent downstream or upstream movement of the apparatus 100, and by extension the drill bit 116. The anchors 122 are extendable to the same length of the braces 120 such that, as the braces 120 extend to move the drill bit 116 towards the blank pipe, the anchors 122 also extend while maintaining the engagement between the blank pipe and the anchor 122. In an extended or partially extended position, the braces 120 extend radially farther than the anchors 122. In a retracted position, the anchors 122 extend radially farther than the braces 120. In some systems, the braces 120 act as anchors during transport and act as braces during milling operations.

The apparatus 100 includes an alignment sub-system 123 to align the apparatus 100 in the wellbore. The alignment sub-system includes a casing collar locator 127. The casing collar locator 127 is configured to sense the depth of the apparatus and/or drill bit relative to the blank pipe. The casing collar locator 127 transmits the location and orientation of the apparatus 100 to the processor 110, so that the processor 110 can confirm that the drill bit 116 is properly aligned with the intended location of an opening. Some alignment sub-systems include other sensors to confirm the location or orientation of the drill bit and to measure the condition of the blank pipe. In some systems, the apparatus includes a camera (not shown) for imaging the blank pipe to detect inflow control devices, openings, plugs, clads, or predetermined locations of the blank pipe. The camera is electronically connected with the processor.

The apparatus 100 further includes a computer system 111 having the processor 110 and a computer-readable medium storing instructions executable by processor 110 to perform operations. The operations include analyzing wellbore data to estimate water cuts of each area of the formation. The wellbore data includes data generated or measured prior to oil recovery operations. Wellbore data can include data generated by a horizontal multi-phase production log and/or saturation logs. Production data includes data generated during oil recovery operations. The operations performed by the processor 110 also include determining high-oil producing areas of the formation that have an estimated water cut between 0% and 20% and/or high-water producing formations that have an estimated water cut of 50% or more. The computer system 111 is operable to control the alignment sub-system 123, a plug sub-system (FIG. 2), and the milling sub-system 102. The computer system 111 prompts the alignment sub-system 123 to align the bit 116 of the apparatus 100 with the identified area of the blank pipe, and actuates the milling sub-system 102 to generate an opening in the blank pipe. The computer system 111 can also prompt the alignment sub-system 123 to align the plug sub-system (FIG. 2) of the apparatus 100 with the identified high-water producing area, and actuate the plug sub-system (FIG. 2) to cover an opening or inflow control device in the blank pipe.

The apparatus 100 further includes a sensor arrangement 125 arranged on the housing 104 of the apparatus. The sensor arrangement is electronically connected to and controlled by the processor 110. The sensor arrangement includes pressure sensors, fluid composition sensors, water cut sensors, pressure gauges, and tubing integrity sensors. The sensor arrangement 125 transmits sensor data to the processor 110 for analysis. The production data includes the sensor data transmitted by the sensor arrangement 125. The sensor arrangement can include a pressure sensor on the drill bit for detecting the connection between the drill bit and the inner surface of the blank pipe. The sensor arrangement may also include a sensor that detects that an opening is completed. In some cases, the sensor arrangement also includes sensors that confirm the condition of the blank pipe prior to milling openings in the blank pipe.

Figure 2:
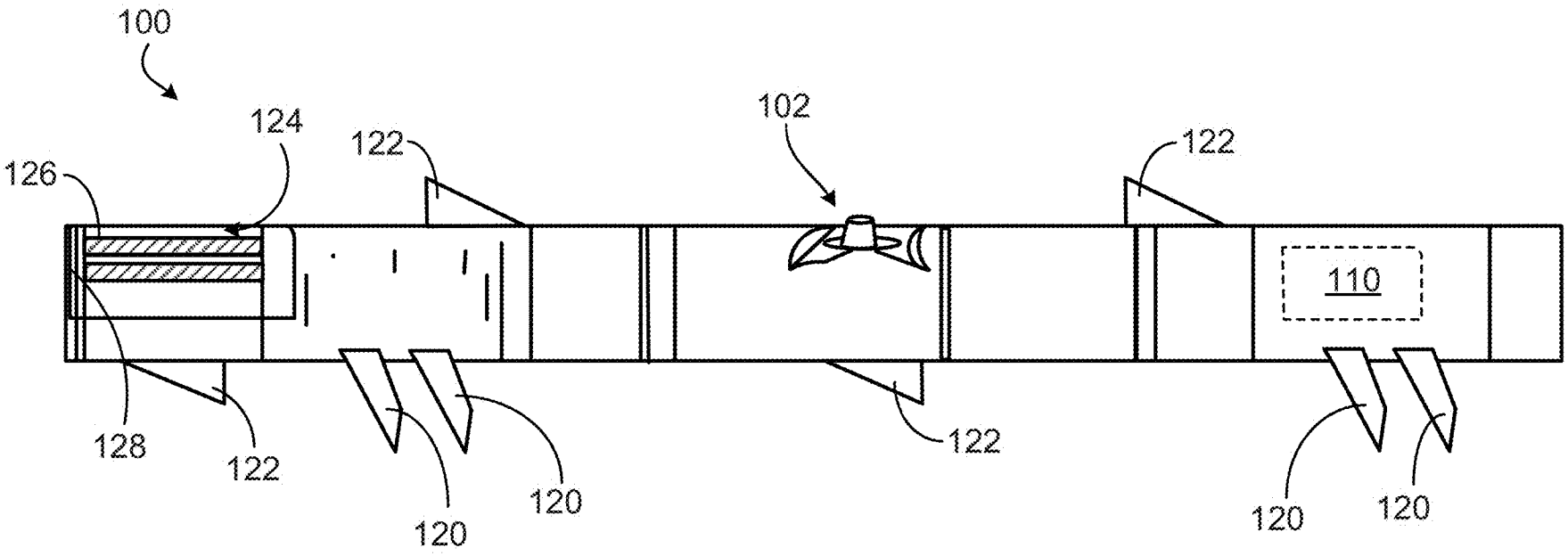
FIG. 2 is a view of a plug sub-system of the apparatus and extendable braces of the milling sub-system of the apparatus.

FIG. 2 is a view of a plug sub-system 124 and the extendable braces 120 of the milling sub-system 102 of the apparatus 100. The plug sub-system 124 is configured to apply a plug, cover, or clad to cover the opening, inflow control device, or both the opening and the inflow control device. The plug sub-system 124 is clad sub-system that mounts a clad 126 to the inner face of the blank pipe. The plug sub-system 124 includes the clads 126 and a clad carrier 128. The clads 126 are releasably held in or attached to the clad carrier 128 until the plug sub-system 124 is actuated by the processor 110. The clad carrier 128 is attached to the wall 106 of the housing 104. The clad 126 has a length of 5 ft to 10 ft and is made of metal.

In some apparatuses, the plug sub-system includes a plug and a plug carrier mounted to the outer surface of the wall. In some cases, the plug sub-system includes mechanical saddles, bridge plugs, or expandable clads. In some systems, the plug sub-system is separate from the apparatus. The computer system is also operatively coupled to the plug sub-system.

The computer system includes the processor 110 and a computer-readable medium storing instructions executable by the processor 110 to perform operations. The operations include identifying a portion of the blank pipe in a high-water producing area of a formation, aligning the plug sub-system 124 with the portion of the blank pipe, and actuating the plug sub-system 124.

FIG. 3A-3E are a cross sectional side views of a system 150 including the apparatus 100 in a horizontal well 152 of a formation 154 and an uncemented blank pipe 156 arranged in the well 152. The system 150 is configured to generate openings in the uncemented blank pipe 156 and close openings in the uncemented blank pipe 156 using the apparatus 100. The system 150 includes the blank pipe 156 arranged in the formation 154. The formation 154 includes areas of high-oil saturation and areas of high-water saturation (low oil saturation). These areas can be estimated prior to oil recovery by performing wellbore modeling.

Figure 3A:
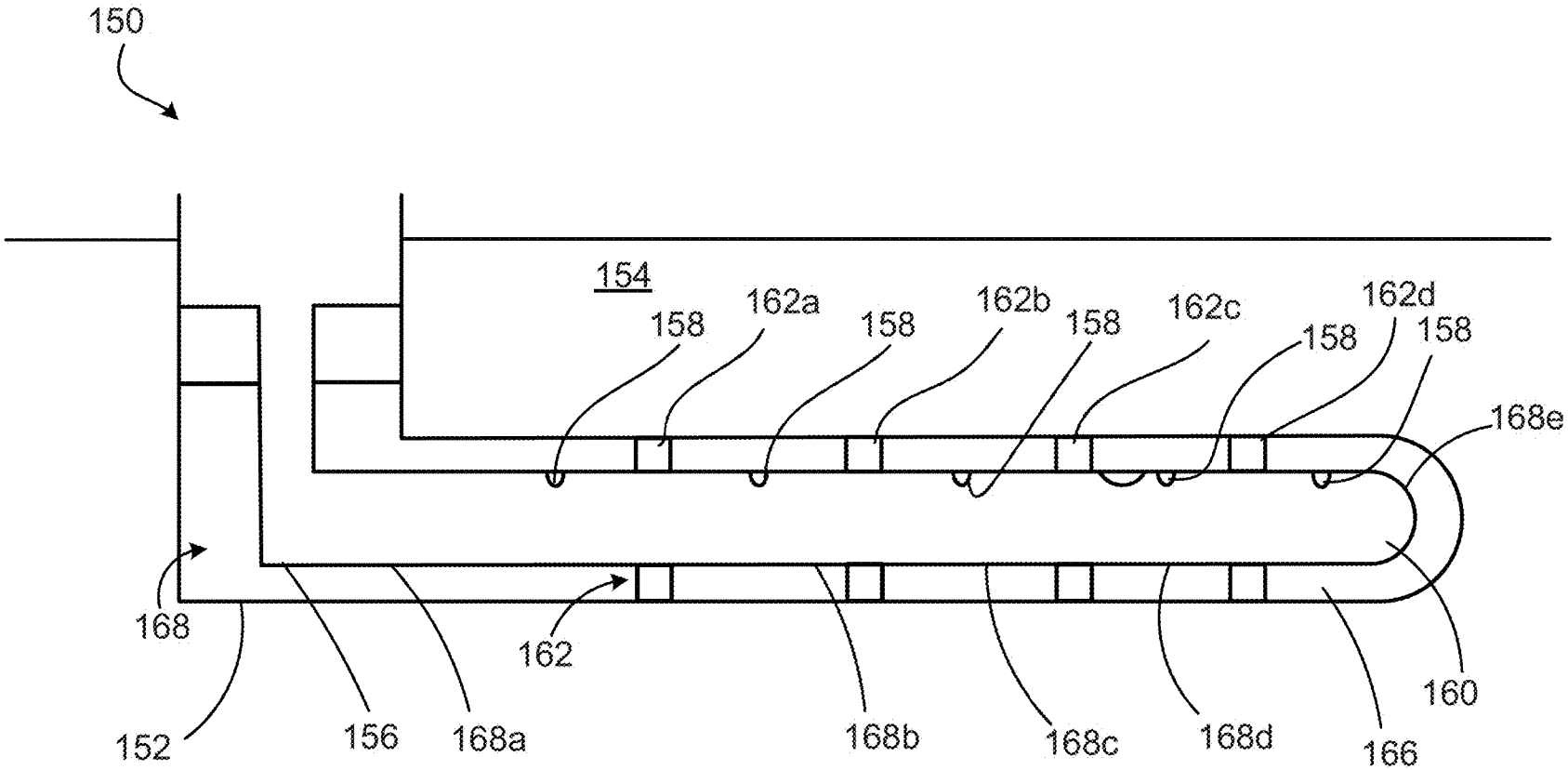
FIG. 3A-3E are cross sectional views of a system including the apparatus in a horizontal wellbore of a formation and an uncemented blank pipe arranged in the wellbore.

FIG. 3A shows a cross-sectional view of the horizontal wellbore 152 and the blank pipe 156 of the system 150. The blank pipe 156 includes inflow control devices (ICDs) 158 that extend through the blank pipe 156. The inflow devices 158 fluidly connect the water and/or oil in the formation 154 to an interior volume 160 of the blank pipe 156. The interior volume 160 is defined by an inner face of the blank pipe 156. The ICDs 158 have a minimum pressure threshold that opens the ICD 158, fluidly connecting the formation 154 to the interior volume 160 of the blank pipe 156. The ICDs 158 act as a throttle for fluid (e.g., water or oil) flowing into the interior volume 160 of the blank pipe 156 at times, creating a pressure drop across the ICD 158. The ICDs are uniform and produce similar inflow rates from portions of the blank pipe. The ICDs 158 are about 2 mm to 6 mm in diameter.

The system 150 further includes multiple packers 162, that have a first packer 162*a*, a second packer 162*b*, a third packer 162*c*, and a fourth packer 162*d*. The packers 162 are arranged circumferentially around the blank pipe 156 in an annulus space 166 defined between the formation 154 and the blank pipe 156. The packers 162 divide the blank pipe 156 into portions 168 of the blank pipe 156. The portions 168 include a first portion 168*a* that is defined from the beginning of the horizontal wellbore 152 to the first packer 162*a*, a second portion 168*b* that is defined from the first packer 162*a* to the second packer 162*b*, a third portion 168*c* that is defined from the second packer 162*b* to the third packer 162*c*, a fourth portion 168*d* that is defined from the third packer 162*c* to the fourth packer, and a fifth portion 168*e* that is defined from the fourth packer 162*d* to an end face 170 of the well 152.

In use, the apparatus 100 moves in the interior volume 160 of the blank pipe 156 to access different portions 168 of the blank pipe 156. Each of the portions 168 of the blank pipe 156 align with corresponding areas of the formation 154. The areas of the formation 154 may be high-oil producing areas or high-water producing areas. In some cases, the high-oil producing areas are depleted over time and transition into high-water producing areas.

Figure 3B:
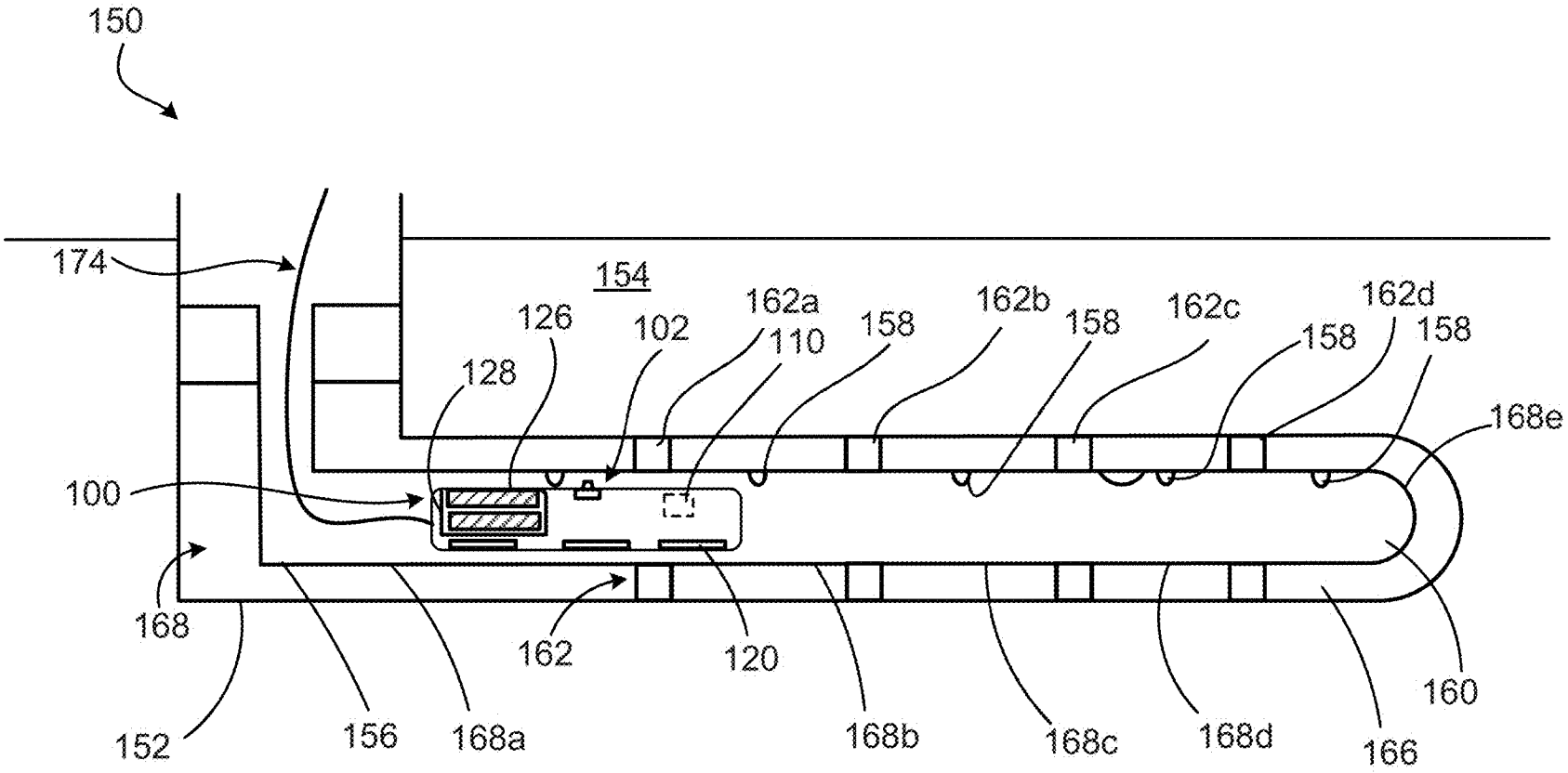

FIG. 3B shows a cross sectional side view of the system 150 as the apparatus 100 aligns with a portion 168 of the blank pipe 156 that corresponds to a high-oil producing area of the formation 154. The apparatus 100 is translated along the blank pipe 156 by a wireline 174 or an active coil. The high-oil producing area of the formation 154 and the associated portion 168 of the blank pipe is identified by well modelling. Wellbore modeling is constructed to design the job, number and size of the ports (opening), and forecast the water cut and/or production rates to run economics of the job design. The well model can be based on wellbore data that includes water cut estimations, productivity tests, productivity logs, recent production data, recent pressure data, current production data, current pressure data, recent horizontal multi-phase logs, water entries, PVT fluid data, relative permeability curves, and oil entries. In the system 150, the second portion 168*b* and fourth portion 168*d* of the blank pipe 156 correspond to high-oil producing areas of the formation 154. The apparatus 100 is aligned with the second portion 168*b* of the blank pipe 156 and the processor 110 actuates the milling sub-system 102. Prior to actuating the milling sub-system 102, the processor defines a predetermined diameter of the opening.

Figure 3C:
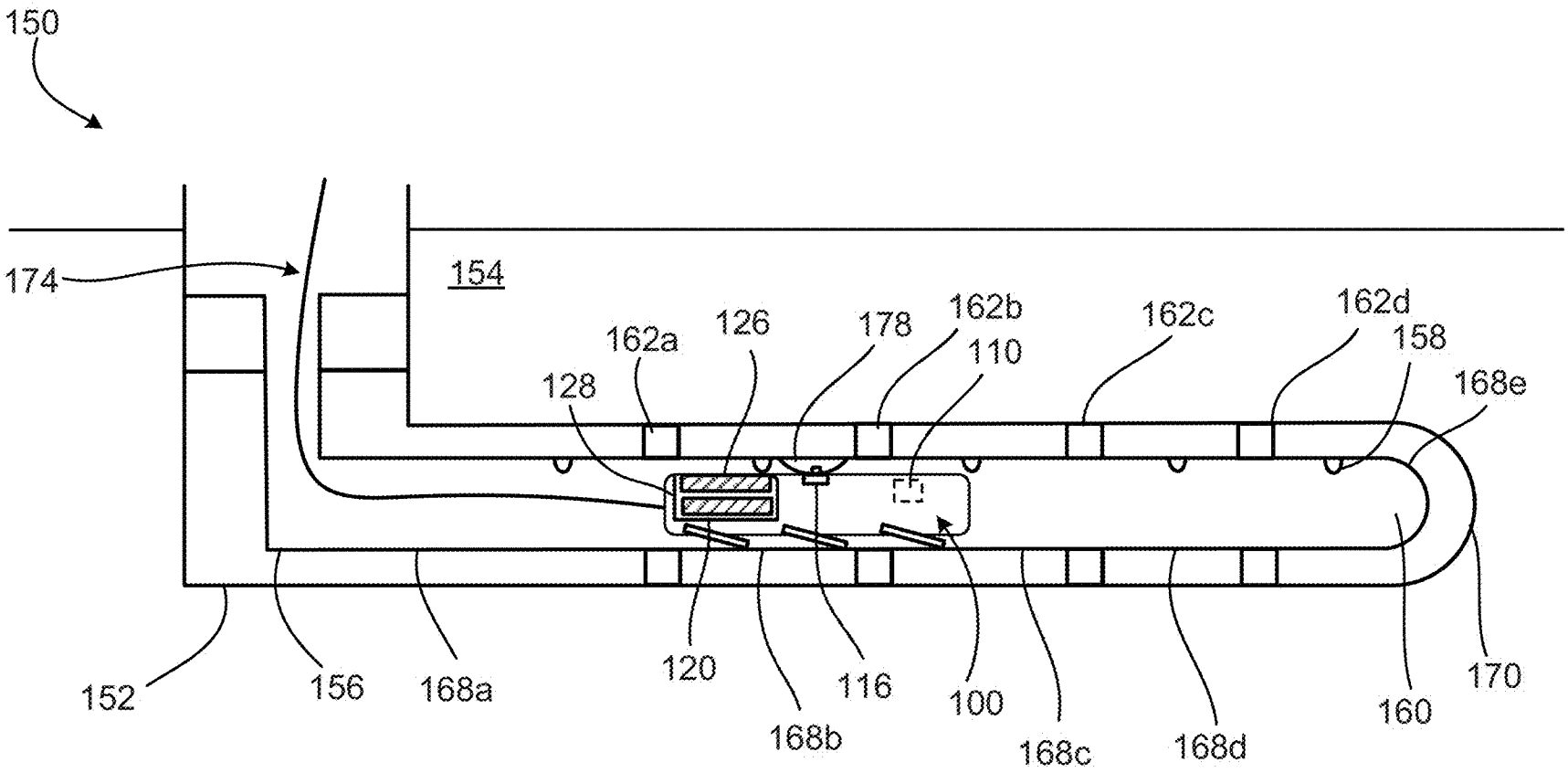

FIG. 3C shows the actuated milling sub-system 102. The milling sub-system 102 generates an opening 178 in the second portion 168*b* of the blank pipe 156. The braces 120 move from the retracted position to the extended position by rotating about a hinge. This movement, presses the apparatus 100 towards the inner face of the blank pipe 156 until the drill bit 116 abuts the inner face of the blank pipe 156. The drill bit 116 rotates by the drill motor 118 and begins to mill the opening 178 into the blank pipe 156. The braces 120 continue to rotate about the hinge and the drill bit 116 continues to apply pressure to the blank pipe 156 until the opening 178 is defined in the blank pipe 156 and has the predetermined diameter. The openings 178 are larger than the ICDs 158 (e.g., about 10 to 50 times larger than the ICD). The diameter of the openings 178 can be between 5 mm and 300 mm (e.g., 10 mm to 30 mm).

After the opening 178 is formed, the milling sub-system 102 is deactivated by the processor 110. The braces 120 move into the retracted position and the apparatus 100 is lowered away from the inner face of the blank pipe 156. The apparatus 100 is free to move uphole or downhole to align the apparatus 100 with a different portion 168 of the blank pipe 156. In the system 150, the apparatus 100 moves downhole to align with the fourth portion 168*d* of the blank pipe 156 that also corresponds to o a high-oil producing area of the formation 154.

Figure 3D:
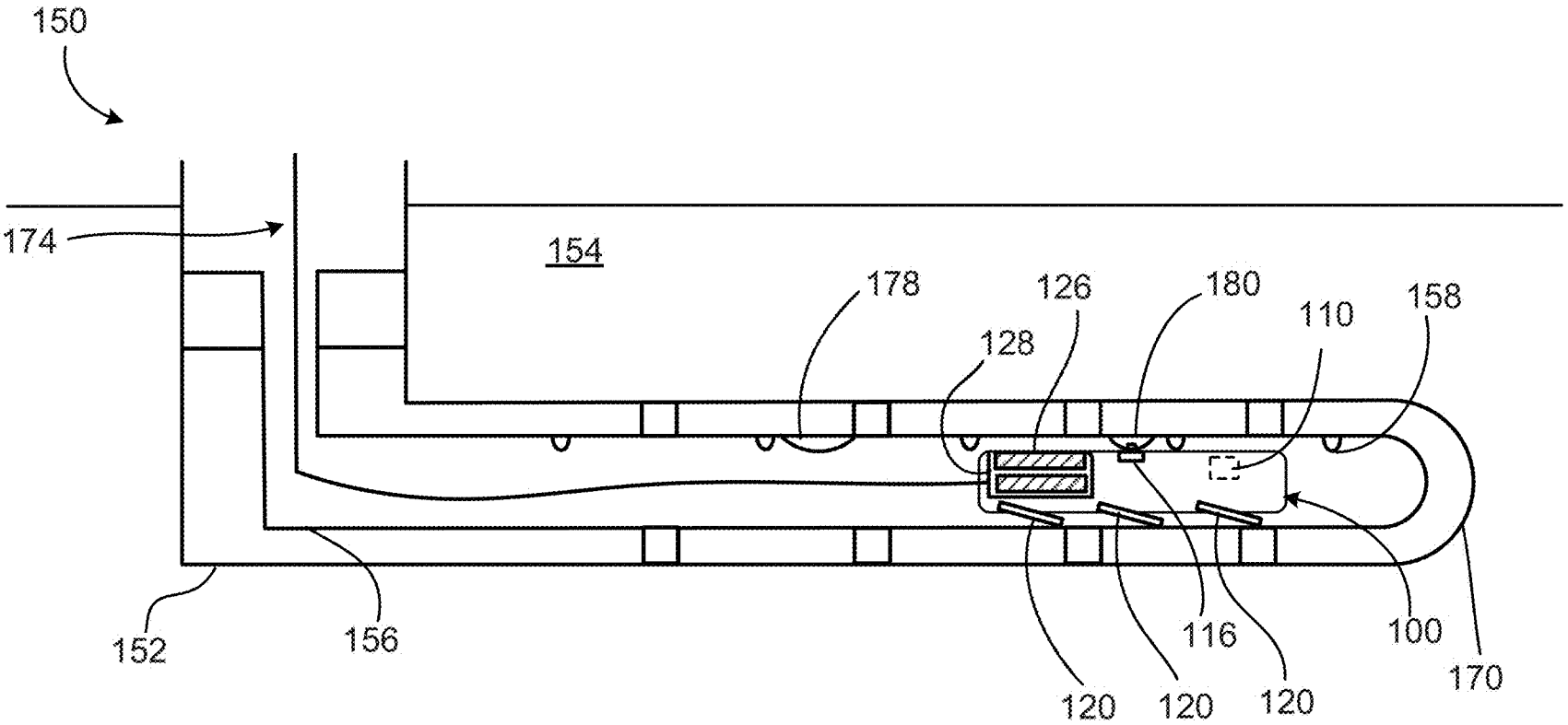
Figure 3E:
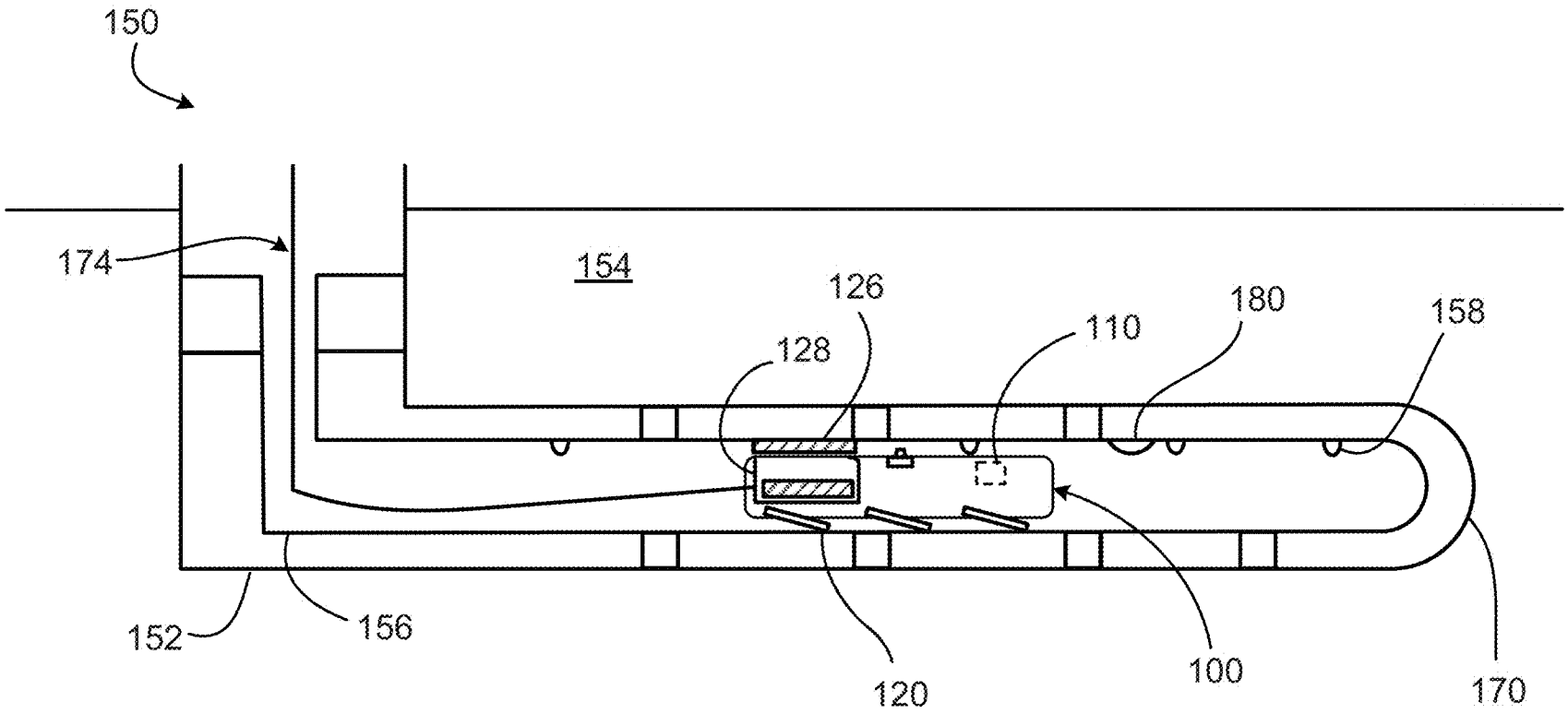

FIG. 3D shows the actuated milling sub-system 102 drilling an opening 180 in the fourth portion 168*d* of the blank pipe 156. The processor 110 actuates the milling sub-system 102 and the braces 120 move into the extended position to apply pressure to the inner face of the blank pipe 156 via the drill bit 116.

FIG. 3D shows the plug sub-system 124 after applying a clad 126 to the second portion 168*b* of the blank pipe 156. In the system 150, the second portion 168*b* was in a high-oil producing area of the formation 154. As the oil moved from the formation 154 to the interior volume 160 of the blank pipe 156, the high-oil producing area transitioned into a high-water producing area. The system 150 detects this transition from high-oil producing to high-water producing and, in response, closes or covers the opening 178 and ICD 158 in the second portion 168*b*. High-water producing areas are detected by the well model and later by analyzing wellbore (production) data generated during the oil production operation. The production data can include water cut estimations or measurements, productivity tests, productivity logs, recent production data, recent pressure data, current production data, current pressure data, recent horizontal multi-phase logs, water entries, and oil entries.

The system may include a multi-phase flow meter (MPFM) installed in the surface to periodically measure well production performance. The MFPM may be connected to the processor of the apparatus or a computer system at the surface connected to the processor. The MPFM periodically measures the production performance constantly, hourly, daily, weekly, monthly, or annually. Data from the MPFM can indicate increases or decreases in water and oil production and therefore increases or decreases in water cuts. If the MPFM data indicates that the water production has increased and the oil production has decreased, the processor or surface computer system can prompt for a PLT log to be run to determine if intervention is beneficial and/or to reevaluate the areas of the formation categorized as high oil-producing and high water-producing. The apparatus can be used to intervene.

The apparatus 100 aligns the plug sub-system 124 (e.g., the clad carrier 128) with an opening 178, 180 and/or and ICD 158 in the blank pipe 156. The processor 110 then actuates the plug sub-system 124 to apply the clad 126 to the inner face of the blank pipe 156. The clad 126 is mounted by a setting tool (not shown) of the plug sub-system. The setting tool translates the clad 126 towards the inner surface of the blank pipe 156 so that the clad is adjacent the opening 178, 180 and/or ICD 158. The setting tool then applies a hydraulic or mechanical force to the clad 126 to increase the diameter of the clad 126. The force may be hydraulic or mechanical. The clad 126 expands such that the entirety of the clad 126 lies flush with the inner surface of the blank pipe and remains mounted to the blank pipe and the opening 178, 180 and/or ICD 158 is sealed by the clad 126. The mechanical forces of the metal in the clad 126 maintain the expanded position after the mechanical or hydraulic force is removed. The clad can be made of metals with high ductility sufficient to allow the clad to expand to the internal diameter of the blank pipe and remain in the expanded configuration. The clad may be coated in oil or water-swelling elastomers to improve sealing. Some plug sub-systems include a plug carrier and plugs. In some cases, the plugs are of various sized to plug the openings and the ICDs. The plugs can be applied to the ICDs and/or openings to stop the inflow of a fluid from the formation. The plugs are made of metal, elastomers, or a combination thereof. The plugs may be expandable. A plug sub-system having a plug is described with further reference to FIG. 6.

Figure 4:
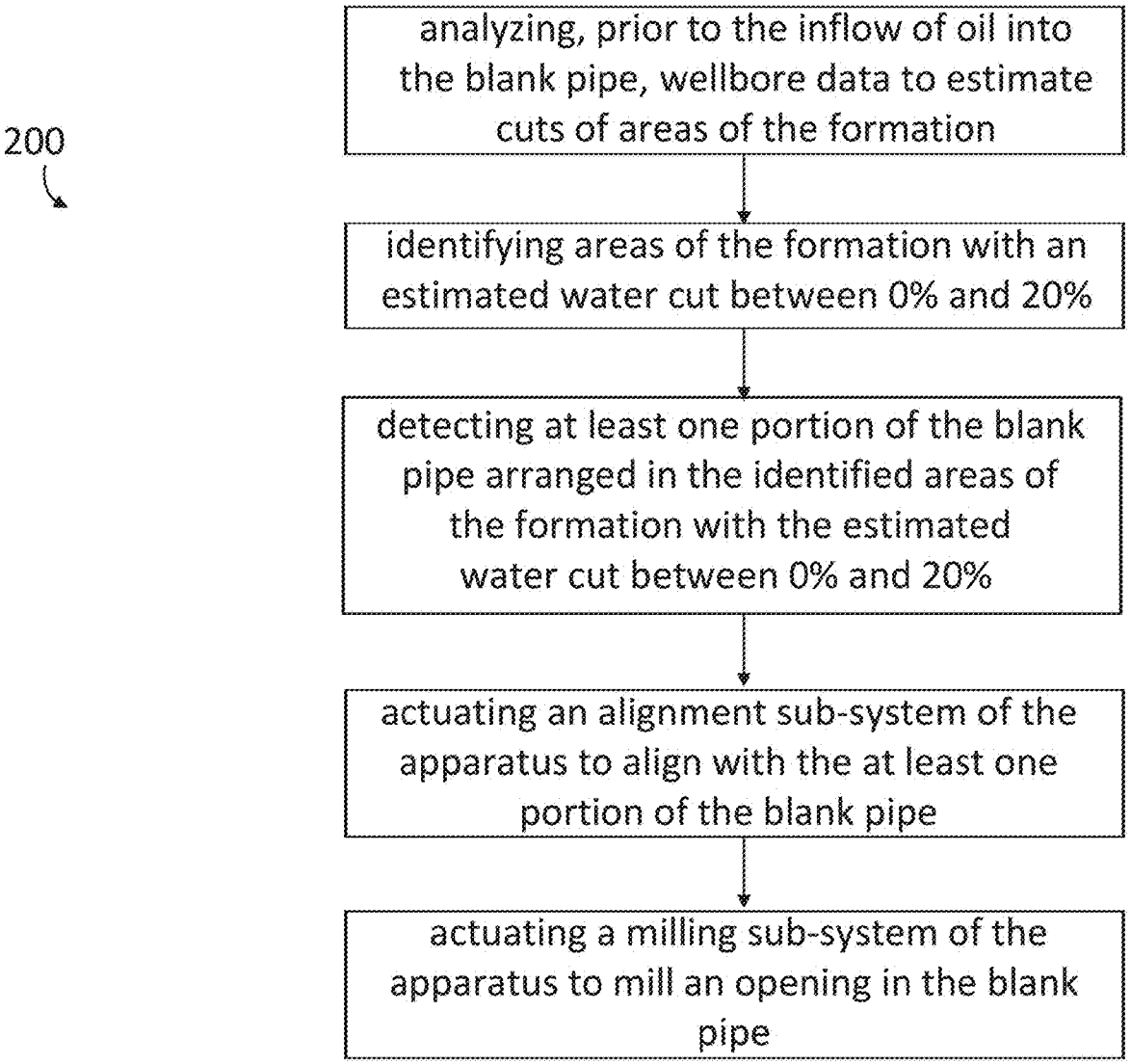
FIG. 4 is a flowchart of a method for generating an opening in a blank pipe.

FIG. 4 is a flowchart of a method 200 for generating an opening in a blank pipe. The method 200 is described with reference to the system 150 described in FIGS. 3A-3E, however, the method 200 can be used with any other system or apparatus. First, a horizontal wellbore 152 is formed and an uncemented blank pipe 156 (e.g., a blank pipe) is arranged in the horizontal wellbore 152. Packers 162 are arranged around the blank pipe 156 and isolate portions 168 of the blank pipe 156, each portion 168 having at least one ICD 158. The portions may be about 200 feet (ft) to about 600 ft in length. The packers 162 are therefore also spaced about 200 ft to about 600 ft apart.

The formation 154 is analyzed to estimate or identify high-water producing areas in the formation and high-oil producing areas of the formation. The processor 110 generates estimates water cuts in all areas of the formation based on wellbore data. Areas with an estimated water cut 0% to about 20% (e.g., 0% to about 30%) are designated as high-oil producing areas of the formation and areas with an estimated water cut of 50% or more are designated as high-water producing areas of the formation. The portions 168 of the blank pipe 156 that correspond to (e.g., are arranged in) the areas of high-water and high-oil are determined by the processor 110 or by the computer system. A model is then generated, by the processor 110 or other computer system connected to the processor, to determine if intervention would be economically valuable. An operator may intervene to determine the economic value of actuating the apparatus 100 to increase oil contribution and/or decrease water contribution. The model determines the location and size of the openings to be milled by the mill sub-system 102 and determines the openings and ICDs to be sealed by the plug sub-system 124. For example, the first portion of the blank pipe may be arranged in a high-oil producing area of the formation whereas the second portion of the blank pipe may be arranged in a high-water producing area of the formation. In such a case, the processor, with the model, identifies the first portion of the blank pipe for milling operations and identifies the second portion of the blank pipe for plugging operations. The milling of an opening in a portion arranged in a high-oil producing area of the formation provides an alternate path for the oil in the formation to bypass the ICD and flow directly into the interior volume 160 of the blank pipe without a pressure drop and without throttling the fluid flow. The closing or plugging of an opening or ICD in the blank pipe prevents the inflow of water into the interior volume 160 of the blank pipe and reduces the amount of water in the recovered fluid.

In the system 150, the second portion 168*b* and the fourth portion 168*d* of the blank pipe 156 are arranged in high-oil producing areas of the formation 154. Thus, the second portion 168*b* and fourth portion 168*d* are identified by the processor 110 as portions 168 of the blank pipe 156 that will be milled by the apparatus 100. In the system 150, there are no areas of the formation 154 that are identified as high-water producing, prior to the insertion of the apparatus 100, however, in some systems, portions of the blank pipe arranged in high water-producing areas of the formation are identified in the initial evaluation of the well (e.g., the well model), prior to apparatus insertion.

After identifying the high-oil producing areas and the high-water producing areas of the formation 154 and the corresponding portions 168 of the blank pipe 156, the apparatus 100 is inserted into the wellbore 152 by a wireline 174. The alignment sub-system 123 moves the apparatus 100 within the blank pipe 156 to align the milling sub-system 102 with the second portion 168*b* of the blank pipe 156 that is arranged in the identified high-oil producing area of the formation 154. A camera arranged on the apparatus may confirm the alignment. In some systems, the portion of the blank pipe that is arranged in the identified high-oil producing area of the formation is a first portion.

The processor 110 determines predefined diameter for an opening on the second portion 168*b* of the blank pipe. The diameter of the opening is determined prior to milling the opening by the processor 110, with the model. The processor 110 analyzes a wellbore model generated based on the wellbore data. The diameter of the opening is large enough to prevent any additional pressure drops across the blank pipe, thereby preventing throttling fluid flow from the formation to the blank pipe. The wellbore data for generating the model may include water cut estimations, oil production data, water production data, PLT data, the water cut of the formation or the areas of the formation, pressure data, well productivity data, temperature data, fluid PVT data, and wellhead pressure data. The processor 110 then activates the milling sub-system 102 of the apparatus 100 such that the opening 178 is milled in the portion 168 of the blank pipe 156 arranged in the high-oil producing area of the formation 154. When the milling sub-system 102 is actuated, the drill bit 116 rotates and the braces 120 move from the retracted position (e.g., flush with the housing 104 of the apparatus 100) into the extended position by rotating about a hinge. In the extended position the braces 120 radially extend from the bottom side 121 and press the upper side 114 of the apparatus 100 towards the inner face of the blank pipe 156. The braces 120 continue to extend as the drill bit 116 of the milling sub-system 102 abuts the inner face of the blank pipe 156. The drill bit 116 generates the opening 178 and continues to enlarge the opening 178. To enlarge the opening, the braces 120 extend radially farther by rotating further about the hinge, thereby pressing the drill bit 116 deeper into the blank pipe 156. In some cases, the drill bit may also translate to enlarge the opening and/or to form a predetermined shape (e.g., an eclipse or an oval). The milling sub-system 102 continues to enlarge the opening 178 until the opening 178 has the predetermined diameter. Such a configuration precisely and non-explosively mills an opening the blank pipe while reducing the risk of cracking the uncemented blank pipe during milling. The opening 178 is about 10 to 50 times larger than the ICD 158 (e.g., 20 mm to 300 mm) and does not throttle or restrict the flow of fluid flowing into the interior volume 160 from the formation 154.

The milling sub-system continues to mill additional openings in the portions 168 of the blank pipe 156 initially identified by the processor 110 as being arranged in a high-oil producing areas of the formation 154.

Figure 5:
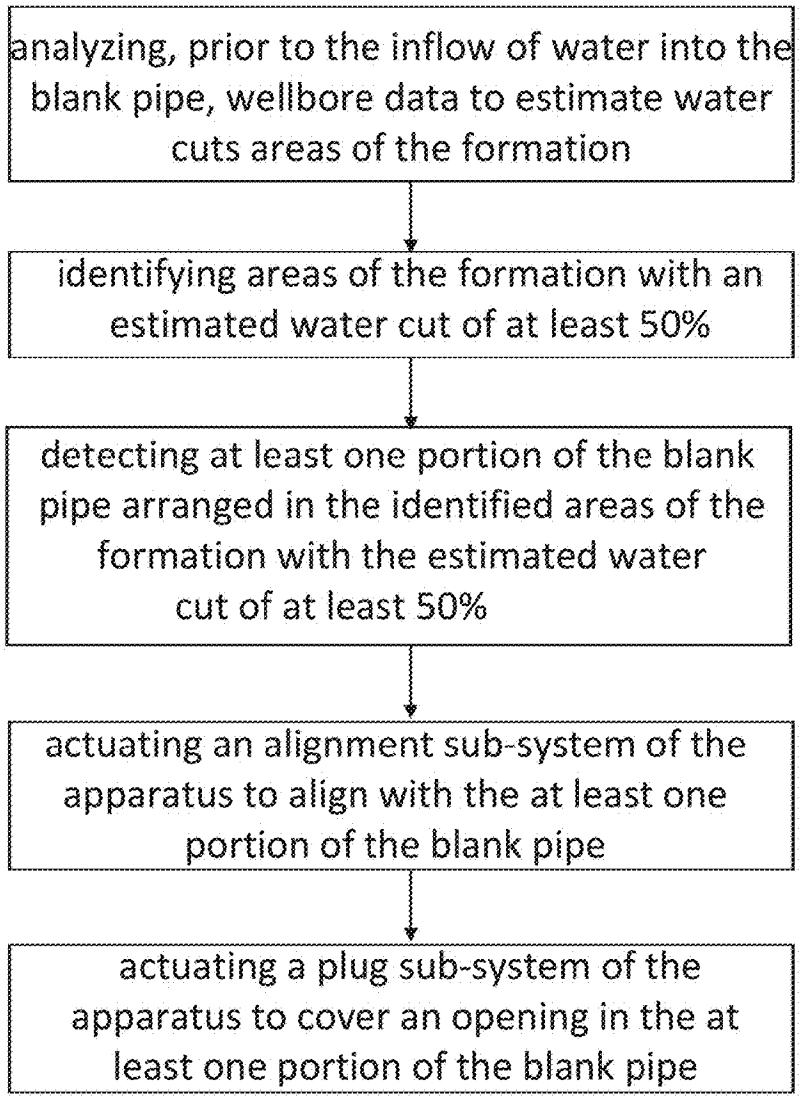
FIG. 5 is a flowchart for covering an opening in a blank pipe.

FIG. 5 is a flowchart for covering an opening in a blank pipe. The method 250 is described with reference to system 150, however, the method 250 may also be used in other systems or apparatuses. Further, the method 250 is described herein as proceeding after the method 200, however, the method 250 may occur prior to the method 200, concurrently with the method 200, or without the method 200. The method 250 includes analyzing, prior to the inflow of oil into the blank pipe, wellbore data to estimate water cuts of areas of the formation. The wellbore data may be used to generate, for example, a well model. The processor 110 initially identifies potential high-water producing areas of the formation 154 based on the well model. After the milling sub-system 102 has milled the openings 178, 180 in the portions 168 of the blank pipe 156, the alignment system 123 of the apparatus 100 aligns the plug sub-system with an ICD or opening of a portion of the blank pipe that was identified by the processor as being arranged in a potentially high-water producing area. The system 150 did not initially identify any portions 168 of the blank pipe as arranged in high water producing areas of the formation 154. In some cases, the processor does initially identify portions of the blank pipe arranged in high-water producing areas, for example, a first or second portion of the blank pipe If a portion is identified as arranged in a high-water producing area of the formation, the apparatus aligns the plug sub-system (e.g., the clad carrier or the plug carrier) with the ICD or opening The processor then actuates the plug sub-system to cover the ICD or opening. The plug sub-system can mount a clad on the inner face of the blank pipe so that the clad covers the ICD and no fluid flows through the ICD from the formation. The clad carrier 128 includes a setting tool (not shown) that applies the clad 126 to the inner surface of the blank pipe 156. The clad carrier 128 releases the clad 126 and the setting tool moves the clad 126 to the inner surface of the blank pipe 156. The clad 126 is initially formed at a diameter smaller than the inner diameter of the blank pipe 156. As the clad 126 abuts the inner surface of the blank pipe, the setting tool applies a force to the clad 126 to increase the diameter of the clad 126. The clad 126 expands such that the entirety of the clad 126 lies flush with the inner surface of the blank pipe and remains mounted to the blank pipe. Some systems insert a plug into the ICD or opening. Covering the ICD and/or opening reduces the inflow of water into the interior volume of the blank pipe, thereby increasing the oil to water ratio of the recovered fluid. In addition, this system reduces the amount of ground water removed from the formation.

At this stage, the portions 168 of the blank pipe 156 have been opened or covered based on the initial identifications of the processor 110. These initial identifications were based on well modelling. During oil recovery, the status of the areas in the formation can change, for example, areas of the formation 154 that were initially high-oil producing areas may be depleted over time and transition into high-water producing areas or some areas in actuality. In some cases, the measured water cuts may be different than the well model predicted or there may be other obstacles inhibiting movement of oil or water from the formation to the blank pipe. As such, real time data is analyzed by the processor 110 or the computer system to determine the current state of the well and update the identified areas of the formation. The processor 110 analyzes production data to analyze the current status of the well. Production data can include measured or calculated water cuts, current well pressure data, recovered fluid composition, PLT log results, and other measured sensor data to determine the areas of high-oil production and areas of high-water production. Based on the current data, the processor 110 identifies new areas that are high-oil producing and new high-water producing areas. The processor 110 also confirms any high-oil or high-water producing areas that were identified in the initial well model. For example, in the system 150, the second portion **168*b* of the blank pipe 156 was initially identified as in a high-oil producing, however, as the oil moved from the formation to the interior volume 160 of the blank pipe 156, the area of the formation 154 transitioned into a high-water producing area. The processor 110 detected this transition by analyzing the production data (e.g., measured or calculated water cuts) and determined that the second portion 168*b* is arranged in a high-water producing area. In response to this determination, alignment sub-system 123 of the apparatus 100 aligns the plug sub-system 124 with the second portion 168*b* and the processor 110 actuates the plug sub-system 124. The plug sub-system mounts a clad 126 onto the inner face of the blank pipe 156 so that the ICD 158 and the opening 178 are covered by the clad 126. In some cases, the clad only covers the opening 178. Some plug sub-systems include plugs and plug carriers. The plug sub-system 124 applies the plug to the ICD and/or the opening when the plug sub-system is actuated by the processor 110**.

Figure 6:
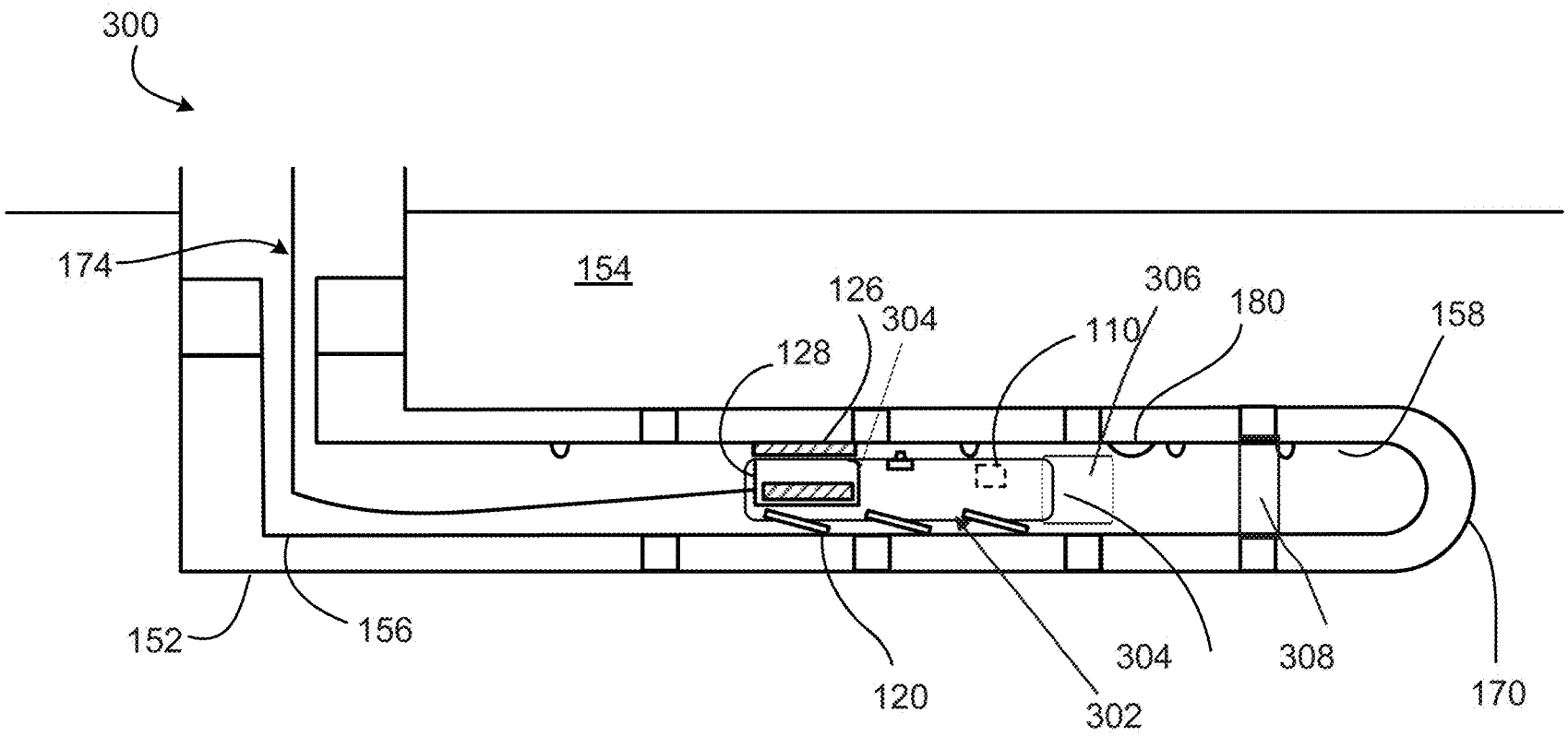
FIG. 6 is cross-sectional side view of a system with an apparatus that milled openings, applied a clad, and applied a plug to a blank pipe.

FIG. 6 is cross-sectional side view of a system 300 with an apparatus 302 that has milled openings 178, 180, applied clads 126, and applied a plug 182 to the blank pipe 156. The system 300 and apparatus 302 are substantially similar to the system 150 and apparatus 100, however, the apparatus 302 has a plug sub-system 304 that includes both a clad carrier 128 and a plug carrier 306. The clad carrier 128 carries and mounts the clad 126 on the inner surface of the blank pipe, as described with reference to FIG. 3D. The plug carrier 306 includes a plug 308 having expandable setting keys (note shown). The plug 308 is releasably mounted to the plug carrier 306. A plug 308 can be placed in the blank pipe 156 to seal off downstream portions of the blank pipe 156 from fluid connection with the surface via the blank pipe 156. The plug 308 is advantageously used when the portion of the blank pipe deepest in the wellbore is arranged in a high water-producing area of the formation 154. In some cases, the deepest portion of the blank pipe and the adjacent portions of the blank pipe are arranged in high water-producing areas. In FIG. 6, the clad 126 and plug 308 are shown as mounted in or on the blank pipe 156. The plug carrier 206 holds the plug 308 and expandable setting keys in a compressed configuration during transport and alignment. The keys of the plug 308 are expandable to at least the diameter of the blank pipe 156. To mount the plug 308, the processor 110 identifies the high-water producing areas of the formation and identifies the portions of the blank pipe 156 arranged in the high water-producing areas of the formation 154. The processor 110 then determines if a plug 308 can be used to fluidly isolate the portions of the blank pipe arranged in the high water-producing areas. The processor 110 prompts the alignment sub-system to align the plug 308 of the plug subsystem 304 with the identified portion of the blank pipe. The plug 308 is arranged at an uphole boundary of the portion of the blank pipe so that the plug 308 is upstream of any openings or ICDs defined in the identified portion of the blank pipe 156. The processor 110 then prompts the plug sub-system to release the compressed plug 308 using a plug running member (not shown) that mechanically electrically, or hydraulically places and activates the plug setting so that the expandable keys of the plug engage with the inner surface of the blank pipe. The plug 308, without the plug carrier 306, expands to abut the inner surface of the blank pipe 156 and seal the identified portion of the blank pipe, and any other portion downhole of the identified portion, from the surface of the wellbore.

In some cases, the plug sub-system of the system is a separate from the apparatus. In such a system, the apparatus mills openings in the portions of the blank pipe arranged in high oil-producing areas and the apparatus is removed from the wellbore. The plug sub-system is then inserted into the wellbore and applies clads and/or plugs to the blank pipe to mitigate water inflow from high water-producing areas of the formation. In some systems, the plug sub-system is deployed prior to the apparatus. The plug sub-system further includes a second processor and an alignment assembly controlled by the second processor. The second processor is connected to the (first) processor of the apparatus and/or to a computer system at the surface. The second processor is substantially similar to the first processor.

In some cases, the processor can also identify high-oil producing area of the formation that performs better than initially modeled. The processor can then actuate the milling sub-system to form a second, third, or fourth opening in the corresponding portion of the blank pipe wellbore to increase the amount of oil flowing into the interior volume of the blank pipe. The new openings can be formed by aligning the milling subs system with the identified portion of the blank pipe. The processor then actuates the milling sub-system to form a second, third, or fourth opening in the identified portion of the blank pipe.

While a method that mills all initial openings then closes openings or ICDs has been describes, some systems mill and cover openings or ICDs as the apparatus moves towards the end face of the wellbore. For example, rather than milling an opening at the second portion and the fourth portion then applying a clad to the third portion, the system can mill an opening in the second portion, apply a clad to the third portion, then mill an opening in the fourth portion.

In some cases, the plug sub-system seals and/or plugs ICDs in the blank pipe prior to milling any openings.

In some cases, the initial well model is generated based on the wellbore data and analyzed by the processor, but no adjustments (e.g., milling or plugging) are made to the blank pipe based on the initial well model. Rather, the apparatus mills or plugs openings based on both the production data gathered during oil recovery and the wellbore data gathered prior to oil recovery.

In some systems, apparatus does not perform initial milling and closing based on a well model but rather is deployed during oil production and determines high-oil producing areas and high-water producing areas based on the current data generated from the oil recovery operation.

Some milling sub-systems form more than one opening in a portion of the blank pipe. The milling sub-assembly can include multiple drill bits.

In some systems, the apparatus rotates relative to the blank pipe to align the drill bit with the inner face of the blank pipe.

In some cases, the processor also actuates the alignment sub-system, the milling sub-system, and/or the plug sub-system based on the estimated structural integrity of the blank pipe. For example, the first portion of the blank pipe arranged in a high-oil producing area of the formation may have multiple openings formed by the milling sub-system of the apparatus. While the openings facilitate the inflow of oil into the blank pipe, multiple openings arranged closely could compromise the integrity of the blank pipe. As such, the processor may prompt the alignment sub-system to rotate or translate the milling sub-system in the blank pipe to spread the openings along the first portion of the blank pipe, thereby reducing the risk of structural failure.

In some apparatuses, the braces are extendable lifts or collapsible arms.

In some milling sub-systems, the braces are a lift arranged at on the upper side of the apparatus at a base of the drill bit. The lift is configured to extend away from the housing of the apparatus and move the drill bit towards an inner face of the blank pipe. In such an embodiment, the hinged arms may be omitted.

In some systems the ICDs are small holes, check valves, or pressure valves.

In some systems the clads and/or plugs are removable by the plug sub-system.

Like reference symbols in the various drawings indicate like elements.

A number of embodiments have been described. Nevertheless, it will be understood that various modifications may be made without departing from the spirit and scope of the system and methods. Accordingly, other embodiments are within the scope of the following claims.

What is claimed is:

1. A method to increase an inflow of oil into a blank pipe, the method comprising:

analyzing, prior to the inflow of oil into the blank pipe, wellbore data to estimate water cuts of areas of a formation, identifying areas of the formation with an estimated water cut between 0% and 20%, detecting at least one portion of the blank pipe arranged in the identified areas of the formation with the estimated water cut between 0% and 20%, actuating an alignment sub-system of an apparatus to align with the at least one portion of the blank pipe, and actuating a milling sub-system of the apparatus to mill an opening in the blank pipe.

2. The method according to claim 1, further comprising:

further detecting at least one second portion of the blank pipe arranged in an area of the formation with an estimated water cut of at least 50%.

3. The method according to claim 1, further comprising:

receiving, during the inflow of oil into the blank pipe, production data from a sensor arrangement of the apparatus, wherein the production data comprises measurements indicative of the measured water cut of the areas of the formation;

identifying an area of the formation that has an measured water cut between 0% and 20%; and actuating an alignment sub-system to align the apparatus with portions of the blank pipe arranged in the identified area of the formation that have an measured water cut between 0% and 20%.

4. The method according to claim 3, further comprising actuating the milling sub-system to mill an opening in the portion of the blank pipe arranged in the area of the formation that has a measured water cut of between 0% and 20%.

* * * * *